US008522564B2

(12) United States Patent
Koppineedi et al.

(10) Patent No.: US 8,522,564 B2
(45) Date of Patent: Sep. 3, 2013

(54) TEMPERATURE CONTROL SYSTEM WITH REFRIGERANT RECOVERY ARRANGEMENT

(75) Inventors: Srinivasa Rao Koppineedi, Andrapradesh (IN); Vladimir Sulc, Minnetonka, MN (US); William L. Waldschmidt, Randolph, MN (US); Joe A. Wermager, Little Canada, MN (US)

(73) Assignee: Thermo King Corporation, Minneapolis, MN (US)

( * ) Notice: Subject to any disclaimer, the term of this patent is extended or adjusted under 35 U.S.C. 154(b) by 273 days.

(21) Appl. No.: 13/154,949

(22) Filed: Jun. 7, 2011

(65) Prior Publication Data

US 2012/0312036 A1 Dec. 13, 2012

(51) Int. Cl.
*F25B 41/00* (2006.01)

(52) U.S. Cl.
USPC ..... 62/113; 62/317; 62/513

(58) Field of Classification Search
USPC ..... 62/113, 117, 129, 317, 513, 515
See application file for complete search history.

(56) References Cited

U.S. PATENT DOCUMENTS

| | | | | |
|---|---|---|---|---|
| 3,248,895 | A | 5/1966 | Mauer | |
| 3,427,819 | A | 2/1969 | Seghetti | |
| 3,681,934 | A | 8/1972 | Tudury | |
| 3,844,131 | A | 10/1974 | Gianni et al. | |
| 4,045,977 | A | 9/1977 | Oliver, Jr. | |
| 4,122,688 | A | 10/1978 | Mochizuki et al. | |
| 4,167,102 | A | 9/1979 | Willitts | |
| 4,437,317 | A | 3/1984 | Ibrahim | |
| 4,457,138 | A | 7/1984 | Bowman | |
| 4,771,610 | A | 9/1988 | Nakashima et al. | |
| 4,831,835 | A | 5/1989 | Beehler et al. | |
| 4,862,702 | A | 9/1989 | O'Neal | |
| 4,912,933 | A | 4/1990 | Renken | |
| 5,136,855 | A | 8/1992 | Lenarduzzi | |
| 5,157,933 | A | 10/1992 | Brendel | |
| 5,172,559 | A * | 12/1992 | Renken et al. | 62/81 |

(Continued)

FOREIGN PATENT DOCUMENTS

JP 58-150756 9/1983

OTHER PUBLICATIONS

Office action dated Jun. 1, 2011 from U.S. Appl. No. 12/245,974, 14 pages.

(Continued)

*Primary Examiner* — Melvin Jones
(74) *Attorney, Agent, or Firm* — Michael Best & Friedrich LLP

(57) ABSTRACT

A temperature control system includes a compressor, a condenser, an evaporator, a receiver, and an accumulator. A valve is positioned between the evaporator and the receiver. An evacuation line has a first end in fluid communication with heat transfer fluid between the valve and the receiver, and a second end in fluid communication with the accumulator. The evacuation line provides for flow of the heat transfer fluid from both of the first heat exchanger and the receiver to the accumulator during an evacuation mode of operation of the temperature control system. The valve can take the form of a check valve or an expansion valve without a bleed port.

21 Claims, 3 Drawing Sheets

(56) References Cited

U.S. PATENT DOCUMENTS

| | | | | |
|---|---|---|---|---|
| 5,381,665 | A | 1/1995 | Tanaka | |
| 5,732,564 | A | 3/1998 | Misawa et al. | |
| 5,752,391 | A | 5/1998 | Ozaki et al. | |
| 5,937,670 | A | 8/1999 | Derryberry | |
| 6,041,849 | A | 3/2000 | Karl | |
| 6,125,643 | A | 10/2000 | Noda et al. | |
| 6,220,044 | B1 | 4/2001 | Sakurai et al. | |
| 6,560,978 | B2 | 5/2003 | Renken et al. | |
| 6,708,510 | B2 * | 3/2004 | Sulc et al. | 62/151 |

OTHER PUBLICATIONS

International Search Report and Written Opinion for Application No. PCT/US2012/028394 dated Feb. 20, 2013 (6 pages).

* cited by examiner

TEMPERATURE CONTROL SYSTEM WITH REFRIGERANT RECOVERY ARRANGEMENT

BACKGROUND

The present invention relates to temperature control systems. More particularly, the present invention relates to a temperature control system for a transport vehicle.

Generally, transport vehicles (e.g., straight trucks and tractor-trailer combinations) are used to transport temperature sensitive cargo that is maintained at predetermined conditions using a temperature control system during transportation to preserve the quality of the cargo. The cargo is transported, stored, or otherwise supported within a cargo space of the transport vehicle.

In some transport units, the temperature control system must be capable of cooling and heating the cargo space to maintain a desired temperature (i.e., a setpoint temperature). A controller switches the temperature control unit between heating and cooling modes based on the relative difference between a sensed temperature and the setpoint temperature to regulate the condition of the cargo space. Typically, the temperature control system is capable of operating a conventional refrigeration cycle utilizing a phase-change refrigerant to cool the cargo space. Refrigerant is compressed by a compressor, condensed, and evaporated in a heat exchanger in thermal communication with the cargo space to cool the cargo space. Heating is typically accomplished by bypassing the condenser and directing hot compressed refrigerant directly to the heat exchanger in thermal communication with the cargo space to heat the cargo space.

SUMMARY

In one embodiment, the invention provides a temperature control system including a compressor configured to compress a heat transfer fluid, a first heat exchanger in fluid communication with the compressor and configured to receive the heat transfer fluid from the compressor and to cool and condense the heat transfer fluid (e.g., up to saturated vapor state), and a second heat exchanger in fluid communication with the first heat exchanger and the compressor and configured to exchange heat with a temperature-controlled space. The system further includes a receiver in fluid communication with each of the first and second heat exchangers. The receiver is positioned between the first heat exchanger and the second heat exchanger and is configured to receive condensed heat transfer fluid from the first heat exchanger and to direct heat transfer fluid to the second heat exchanger. A valve is positioned between the receiver and the second heat exchanger. An accumulator is in fluid communication with the second heat exchanger and the compressor and is configured to receive a mixture of liquid and vapor heat transfer fluid from the second heat exchanger and direct a vapor portion of the heat transfer fluid to the compressor. An evacuation line has a first end in fluid communication with and positioned between the valve and the receiver, and a second end in fluid communication with the accumulator. The evacuation line provides for flow of the heat transfer fluid from both of the first heat exchanger and the receiver to the accumulator during an evacuation mode of operation of the temperature control system. The valve substantially prevents the flow of heat transfer fluid from the second heat exchanger into the receiver In another embodiment the invention provides a method of operating a temperature control system having a compressor, a first heat exchanger downstream of the compressor, a receiver downstream of the first heat exchanger, a valve downstream of the receiver, a second heat exchanger downstream of the valve, and an accumulator downstream of the second heat exchanger. The system can be operated in a cooling mode by compressing a heat transfer fluid with the compressor, directing the heat transfer fluid from the compressor to the first heat exchanger with a valve arrangement in a first configuration, cooling and condensing the heat transfer fluid from the compressor in the first heat exchanger, exchanging heat with a temperature-controlled space with the second heat exchanger, receiving a mixture of liquid and vapor heat transfer fluid from the second heat exchanger into the accumulator, and directing a vapor portion of the heat transfer fluid in the accumulator to the compressor. The system can be operated in an evacuation mode by opening a purge valve coupled to an evacuation line. The evacuation line has a first end in fluid communication with and between the valve and the receiver, and a second end in fluid communication with the accumulator. The evacuation line provides flow of the heat transfer fluid from both of the first heat exchanger and the receiver to the accumulator without passing through the second heat exchanger. The valve substantially prevents the flow of heat transfer fluid from the second heat exchanger into the receiver. The system can be further operated in a heating mode by moving the valve arrangement from the first configuration to a second configuration, directing the heat transfer fluid from the compressor to the second heat exchanger without passing through the first heat exchanger, and maintaining the purge valve open.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

Figure 1:
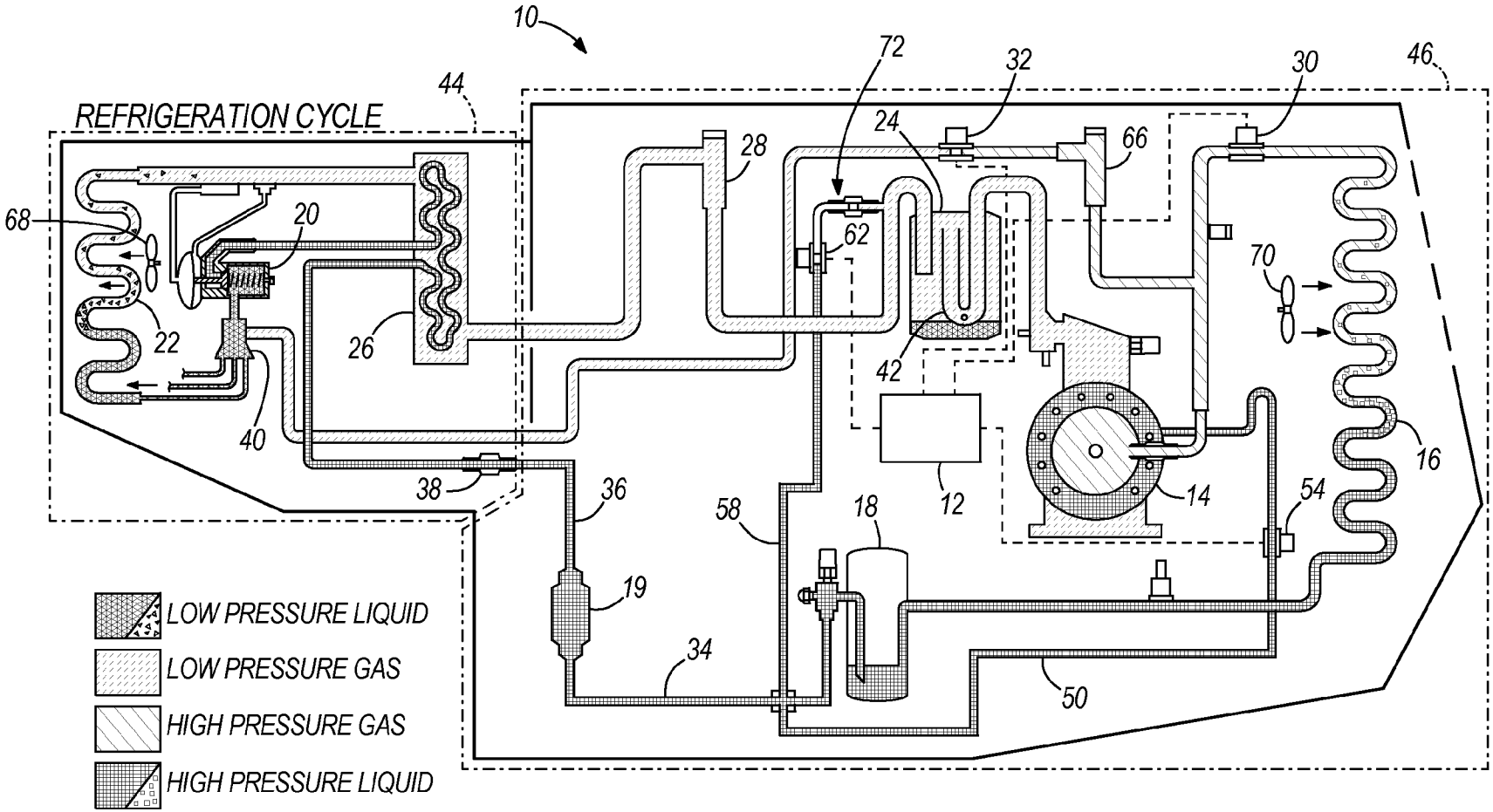
FIG. 1 is a schematic of a temperature control system according to one embodiment of the present invention, illustrating a cooling mode.
Figure 2:
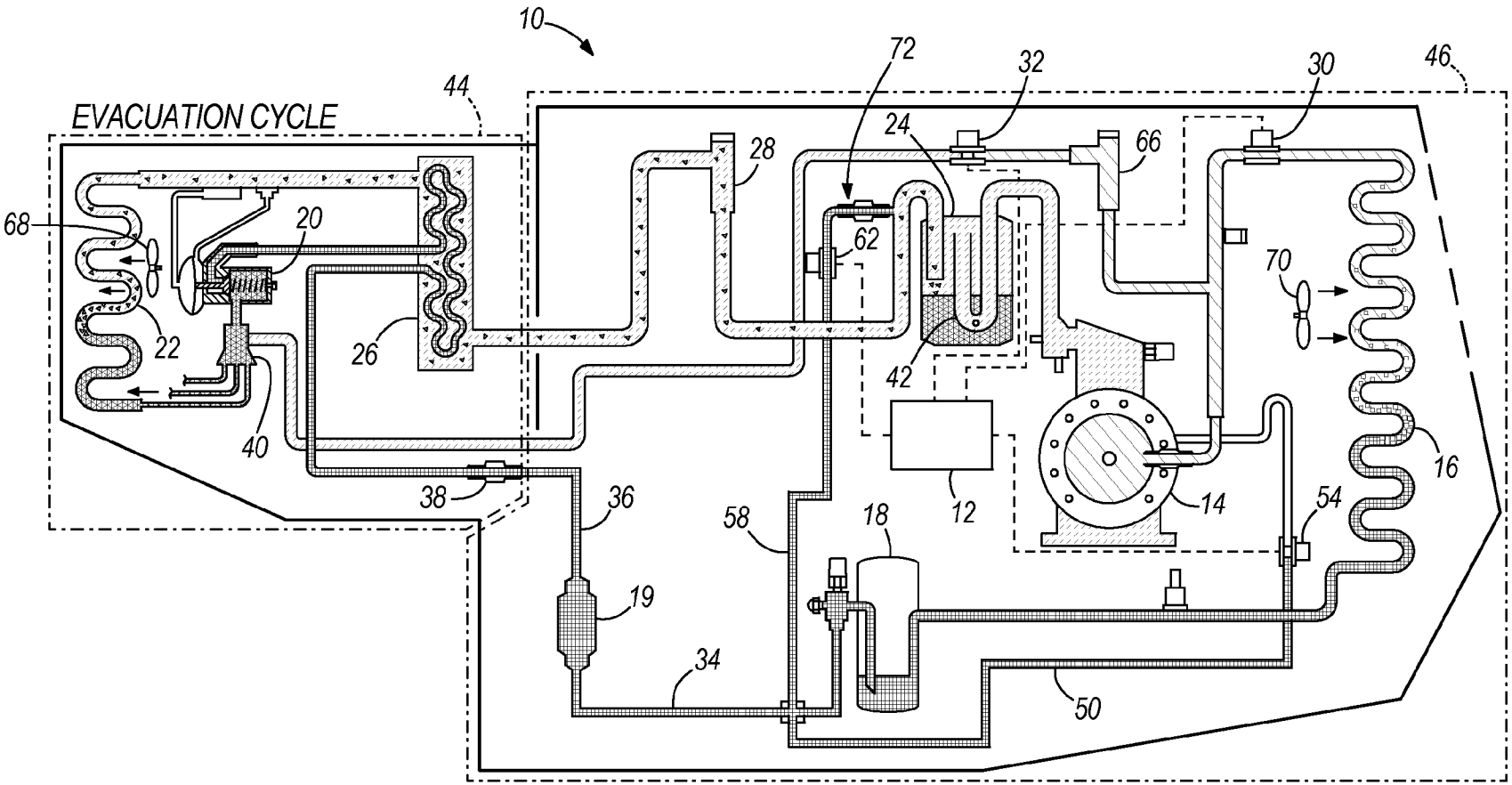
FIG. 2 is a schematic of the temperature control system of FIG. 1, illustrating a condenser evacuation mode.
Figure 3:
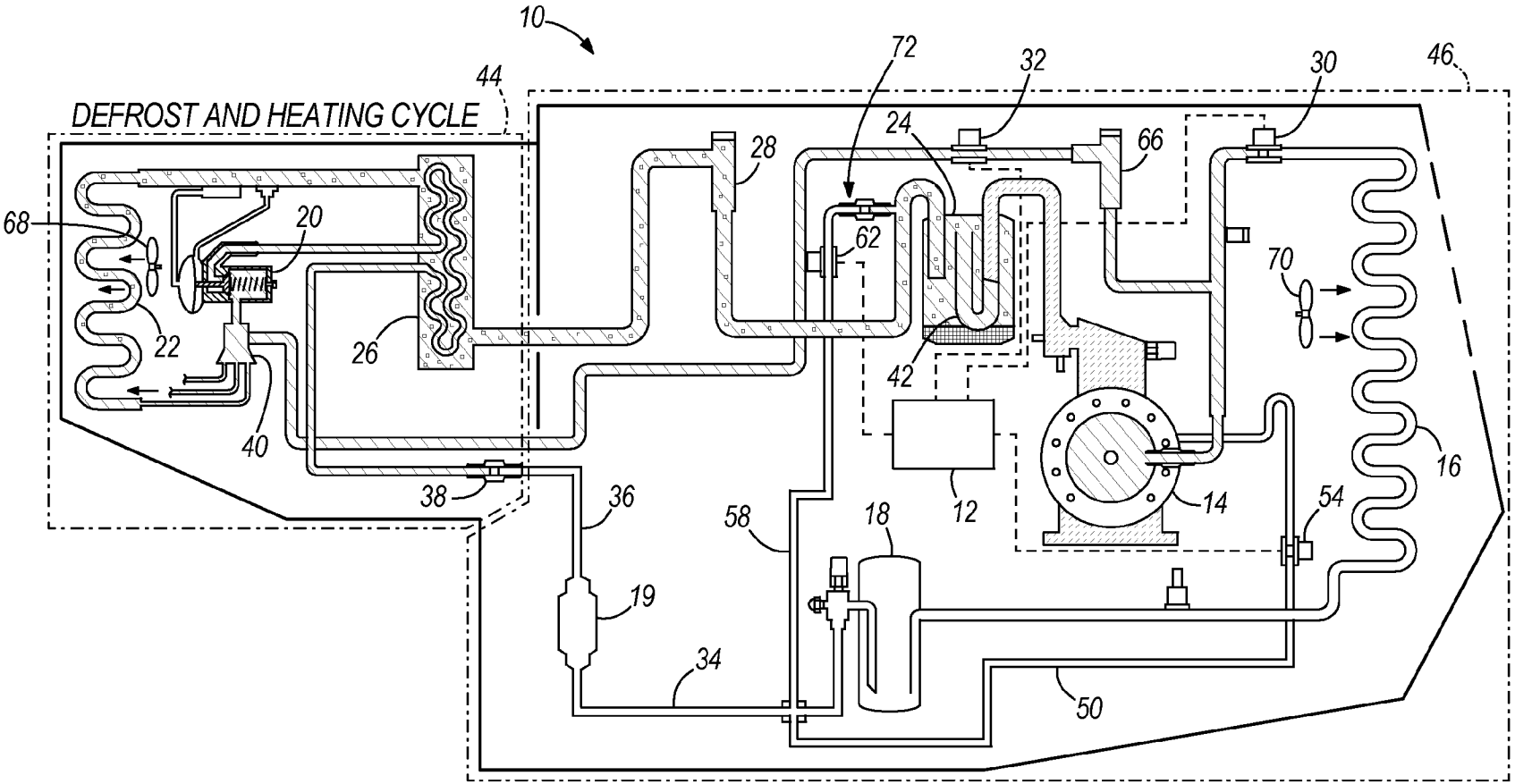
FIG. 3 is a schematic of the temperature control system of FIG. 1, illustrating a heating/defrost mode.

FIGS. 1-3 illustrate a temperature control system 10 for a transport vehicle. The temperature control system 10 is capable of cooling and heating a cargo space of the transport vehicle to maintain a desired temperature (i.e., a setpoint temperature). The temperature control system 10 includes a controller 12 that switches the temperature control system 10 between heating and cooling modes based on the relative difference between a sensed temperature and the setpoint temperature to regulate the condition of the cargo space. It is to be understood that the refrigeration system 10 may be utilized for other refrigeration applications and is not limited to transport refrigeration applications.

The temperature control system 10 includes a compressor 14, a first heat exchanger or condenser 16, a receiver 18, a filter/dryer 19, an expansion valve 20, a second heat exchanger or evaporator 22, and an accumulator 24 connected in series by fluid conduits. The first heat exchanger 16 is in thermal communication with air outside of the transport vehicle. The second heat exchanger 22 is in thermal communication with air inside the cargo space of the transport vehicle. In other constructions, there may be more than one heat exchanger in thermal communication with air inside the cargo space. A distributor 40 may be employed, as is well known in the art, to distribute refrigerant to a plurality of second heat exchangers (not shown). A first portion 44 of the temperature control system 10, including the second heat exchanger 22, is preferably positioned within the cargo space. A second portion 46 of the temperature control system 10, including the first heat exchanger 16, is preferably positioned outside of the cargo space.

In the cooling mode or refrigeration cycle (see FIG. 1), the receiver 18 receives a heat transfer fluid (e.g., refrigerant) from the first heat exchanger 16 and directs refrigerant through the filter/dryer 19 and to the second heat exchanger 22. The expansion valve 20 reduces the pressure of the refrigerant just upstream of the second heat exchanger 22. The illustrated expansion valve 20 is a conventional thermostatic expansion valve having a bleed port. The accumulator 24 receives a liquid and gaseous mixture of refrigerant from the second heat exchanger 22. Liquid refrigerant accumulates at the bottom of the accumulator 24 and gaseous refrigerant is displaced to the top. The accumulator 24 includes a U-tube 42 (i.e., a U-shaped tube) for drawing gaseous refrigerant from the top of the accumulator 24 into the compressor suction line, as is well known in the art.

The temperature control system 10 also includes a suction line heat exchanger 26 and a throttling valve 28. The suction line heat exchanger 26 is a shell and tube heat exchanger that transfers heat between the warm liquid refrigerant entering the second heat exchanger 22 and cold vapor refrigerant leaving the second heat exchanger 22. The throttling valve 28 is positioned between the suction line heat exchanger 26 and the accumulator 24. It is to be understood that other types of heat exchangers may be used to accomplish the same results.

First and second compressor outlet solenoid valves 30 and 32 together define a valve arrangement operable to direct high pressure refrigerant exiting the compressor 14. The first solenoid valve 30 is sometimes referred to as a condenser block-off solenoid, and the second solenoid valve is sometimes referred to as a hot gas defrost solenoid. In a first configuration, the first compressor outlet solenoid valve 30 is opened and the second compressor outlet solenoid valve 32 is closed (FIGS. 1 and 2). In this first configuration, refrigerant is directed from the compressor 14 to the first heat exchanger 16. In a second configuration, in which the first compressor outlet solenoid valve 30 is closed and the second compressor outlet solenoid valve 32 is open (FIG. 3), refrigerant is directed from the compressor 14 to the second heat exchanger 22. In the first configuration, a refrigeration or cooling circuit is formed. In the second configuration, a heating/defrost circuit is formed. The controller 12 controls the position and energization of the solenoid valves 30 and 32 in a manner well understood in the art. In other embodiments, a conventional three-way valve could be substituted for the two solenoid valves 30, 32. In yet other constructions, other types of valve arrangements or switching mechanisms may be employed to switch the system between a refrigeration circuit and a heating/defrost circuit.

The temperature control system 10 is operable in a cooling mode, an evacuation mode, and a heating/defrost mode. The controller 12 communicates with the first and second compressor outlet solenoid valves 30, 32 to achieve the first configuration during the cooling mode and the evacuation mode, and to achieve the second configuration during the heating/defrost mode.

During the cooling mode, illustrated in FIG. 1, the first and second compressor outlet solenoid valves 30, 32 are the first configuration to direct high pressure gas refrigerant from the compressor 14 to the first heat exchanger 16. The high pressure gas refrigerant is condensed in the first heat exchanger 16 to a high pressure liquid refrigerant, which is directed to the receiver 18. The receiver 18 ensures that only liquid refrigerant is directed toward the second heat exchanger 22. The high pressure liquid refrigerant is directed through a line 34 to the filter/dryer 19 and then through a line 36 to the suction line heat exchanger 26 to be pre-cooled by low pressure refrigerant exiting the second heat exchanger 22. A one-way check valve 38 is positioned in the line 36, downstream of the filter/dryer 19, to substantially prevent back flow of refrigerant from the suction line heat exchanger 26 toward the filter/dryer 19. One of ordinary skill in the art will understand that while the check valve 38 is intended to completely prevent back flow, there may or will be, in actuality, a small amount of leakage past the check valve 38 in normal operation during the evacuation mode and the heating mode.

After passing through the suction line heat exchanger 26, the high pressure liquid refrigerant is passed through the expansion valve 20 to lower the pressure of the refrigerant. At least a portion of the refrigerant evaporates in the second heat exchanger 22 to create a mixture of low pressure liquid and low pressure gas. The mixture passes through the second heat exchanger 22 and absorbs heat from air being directed into the cargo space to thereby cool the cargo space. Vapor refrigerant exits the heat exchanger 22 and then passes through the suction line heat exchanger 26 and exchanges heat with the high pressure liquid refrigerant approaching the second heat exchanger 22. Then, the vapor refrigerant goes to the compressor suction line via the accumulator 24.

The illustrated compressor 14 is a scroll compressor that is cooled during the cooling mode using a portion of the high pressure liquid refrigerant. A liquid injection cooling line 50 is fluidly connected between the compressor 14 and the line 34 such that a portion of the high pressure liquid refrigerant can flow from the line 34 (at a point downstream of the receiver 18) back to the compressor 14 to help cool the internal components of the compressor 14. A solenoid valve 54 controls flow of the refrigerant through the liquid injection cooling line 50. Specifically, the valve 54 is opened during the cooling cycle to permit the flow of high pressure liquid refrigerant back to the compressor 14, and is closed during the evacuation mode and the heating/defrost modes. Other embodiments of the invention could use other types of compressors (e.g., a Swash plate compressor/reciprocating compressor), and may or may not incorporate the liquid injection cooling line 50 and the associated solenoid valve 54.

The temperature control system 10 remains in the cooling mode until a heating or defrost operation is needed. When a heating or defrost operation is needed, the controller 12 switches to the evacuation mode.

The evacuation mode, illustrated in FIG. 2, is operated between the cooling and heating/defrost modes to move refrigerant from the high pressure side to the low pressure side for use during the heating/defrost mode. During the evacuation mode, the first and second compressor outlet solenoid valves 30, 32 are in the first configuration. The system 10 includes an evacuation line 58 that fluidly connects the first heat exchanger 16, the receiver 18, the filter/dryer 19, and the liquid injection cooling line 50 (if present) to the accumulator 24, bypassing the suction line heat exchanger 26, the expansion valve 20 and the second heat exchanger 22. A purge valve 62 controls the flow of liquid refrigerant through the evacuation line 58, and in the illustrated embodiment is a solenoid valve that can be opened to allow the flow of refrigerant through the evacuation line 58 or closed to prevent the flow of refrigerant through the evacuation line 58. During the cooling mode, the controller 12 ensures that the purge valve 62 is closed to prevent the movement of high pressure liquid refrigerant into the accumulator 24.

Upon entering the evacuation mode, the controller 12 opens the purge valve 62 to allow passage through the evacuation line 58 of high pressure liquid refrigerant from the receiver 18 and the first heat exchanger 16 into the accumulator 24. The controller 12 may switch OFF evaporator fans 68 (or may close the damper door if the evaporator fans are directly-driven, mechanical fans). Also, the controller 12 may switch OFF condenser fans 70 to build the head pressure for better evacuation in low ambient temperatures. High pressure liquid refrigerant also flows through the evacuation line 58 and into the accumulator 24 from the filter/dryer 19 and possibly from the liquid injection cooling line 50. The check valve 38, which is in the line 36 downstream of the filter/dryer 19 and upstream of the suction line heat exchanger 26, substantially prevents refrigerant in the second heat exchanger 22 and in the suction line heat exchanger 26 from flowing back to the filter/dryer 19, the line 34, the evacuation line 58, and/or the receiver 18 where it may tend to condense, especially in cold ambient temperature conditions. The check valve 38 thereby substantially prevents the evaporator-side refrigerant from flowing back through the evacuation line 58 during the evacuation cycle. In some embodiments, in which the expansion valve does not include a bleed port, the check valve 38 can be eliminated since the expansion valve, which is closed due to elevated evaporator pressure during the heating mode, would operate to substantially prevent the flow of heat transfer fluid from the second heat exchanger 22 into the filter/dryer 19, the evacuation line 58, and the receiver 18. In contrast to the bleed port design, which intends to allow flow through the bleed port when the expansion valve 20 is closed, this alternative expansion valve without a bleed port is intended to completely prevent back flow when closed, although, in actuality, a small amount of leakage may occur past this expansion valve design.

Refrigerant introduced to the accumulator 24 through the evacuation line 58 becomes available for use during the heating/defrost cycle. The amount of refrigerant moved into the accumulator 24 is large enough to enhance the capacity for heating, and in the illustrated embodiment is all of the refrigerant from the first heat exchanger 16, the receiver 18, and the filter/dryer 19.

When the controller determines that enough time has passed to evacuate the refrigerant from the first heat exchanger 16, the receiver 18, and the filter/dryer 19 to the accumulator 24, it switches the first and second compressor outlet solenoid valves 30, 32 to the second configuration and initiates the heating/defrost mode. The purge valve 62 remains in the open position during the heating/defrost cycle so that any refrigerant that may leak past the check valve 38 or the compressor outlet solenoid valve 30 can be evacuated to the accumulator 24 via the evacuation line 58 for use during the heating/defrost cycle. A check valve 72 downstream of the purge valve 62 prevents the back flow of refrigerant if the pressure in the accumulator 24 is higher than the pressure in evacuation line 58. This may happen in low ambient temperatures.

During the heating/defrost mode, illustrated in FIG. 3, refrigerant bypasses the first heat exchanger 16 and hot gas refrigerant is directed from the compressor 14 to the second heat exchanger 22 to heat the cargo space or to defrost the second heat exchanger coil. A pressure regulating device 66 (e.g., a differential pressure regulating (DPR) valve) is positioned between the compressor 14 and the second heat exchanger 22. Refrigerant is directed from the compressor 14 to the pressure regulating device 66 to the second heat exchanger 22, bypassing the expansion valve 20. The refrigerant goes through the second heat exchanger coil 22 where it is cooled and/or partially condensed. As the refrigerant passes through the second heat exchanger 22, the refrigerant releases heat either to ice formed on the external surfaces of the second heat exchanger 22 to thereby defrost the second heat exchanger 22, to air being directed into the cargo space to thereby heat the cargo space, or to both.

The refrigerant enters the accumulator 24, where condensed liquid refrigerant is separated from vapor refrigerant. The vapor refrigerant returns to the compressor by way of U-tube 42 and is compressed to a high pressure and high temperature gas, and the cycle repeats.

If cooling is demanded, the controller 12 switches to the refrigeration mode by switching the first and second compressor outlet solenoid valves 30, 32 to the first configuration and closing the purge valve 62.

Various features and advantages of the invention are set forth in the following claims.

What is claimed is:

1. A temperature control system comprising:

a compressor configured to compress a heat transfer fluid;

a first heat exchanger in fluid communication with the compressor and configured to receive the heat transfer fluid from the compressor and to cool and condense the heat transfer fluid;

a second heat exchanger in fluid communication with the first heat exchanger and the compressor and configured to exchange heat with a temperature-controlled space;

a receiver in fluid communication with each of the first and second heat exchangers, the receiver positioned between the first heat exchanger and the second heat exchanger and configured to receive condensed heat transfer fluid from the first heat exchanger and to direct heat transfer fluid to the second heat exchanger;

a valve positioned between the receiver and the second heat exchanger;

an accumulator in fluid communication with the second heat exchanger and the compressor and configured to receive a mixture of liquid and vapor heat transfer fluid from the second heat exchanger and direct a vapor portion of the heat transfer fluid to the compressor;

an evacuation line having a first end in fluid communication with and positioned between the valve and the receiver, and a second end in fluid communication with the accumulator, the evacuation line providing for flow of the heat transfer fluid from both of the first heat exchanger and the receiver to the accumulator during an evacuation mode of operation of the temperature control system;

a valve arrangement in fluid communication with the first heat exchanger, the compressor, and the second heat exchanger, the valve arrangement operable in a first configuration and a second configuration, wherein the first configuration is operable to direct the heat transfer fluid from the compressor to the first heat exchanger and the second configuration is operable to direct the heat transfer fluid from the compressor to the second heat exchanger without passing through the first heat exchanger; and a controller in electrical communication with the valve arrangement, the controller operable to move the valve arrangement between the first configuration and the second configuration, wherein the valve substantially prevents the flow of heat transfer fluid from the second heat exchanger into the receiver.

2. The temperature control system of claim 1, wherein the valve is positioned between the second heat exchanger and a filter/dryer.

3. The temperature control system of claim 2, wherein the first end of the evacuation line is positioned between the filter/dryer and the receiver.

4. The temperature control system of claim 1, wherein the valve is a check valve.

5. The temperature control system of claim 1, wherein the valve is an expansion valve without a bleed port.

6. The temperature control system of claim 1, further comprising a purge valve movable between a closed position, preventing flow of heat transfer fluid through the evacuation line to the accumulator, and an open position, allowing flow of heat transfer fluid through the evacuation line to the accumulator without passing through the second heat exchanger, wherein the purge valve is in the open position in at least one of the evacuation mode and a heating mode of the temperature control system.

7. The temperature control system of claim 6, wherein the purge valve is in the open position in both of the evacuation mode and the heating mode of the temperature control system.

8. The temperature control system of claim 6, wherein the evacuation mode defines an evacuation circuit configured to allow at least a portion of the condensed heat transfer fluid to enter the accumulator from the first heat exchanger and the receiver, bypassing the second heat exchanger, wherein the evacuation circuit includes the compressor, the first heat exchanger, the receiver, the evacuation line, and the accumulator fluidly connected in series.

9. The temperature control system of claim 1, wherein the temperature control system enters the evacuation mode after the temperature control system exits a cooling mode and before the temperature control system enters a heating mode.

10. The temperature control system of claim 1, wherein the first configuration corresponds to a cooling mode of the temperature control system and the second configuration corresponds to a heating mode of the temperature control system.

11. The temperature control system of claim 10, wherein the cooling mode defines a cooling circuit for cooling the temperature-controlled space, wherein the cooling circuit includes the compressor, the first heat exchanger, the receiver, the second heat exchanger, and the accumulator fluidly connected in series.

12. The temperature control system of claim 11, wherein the heating mode defines a heating circuit for at least one of defrosting the second heat exchanger and heating the temperature-controlled space, wherein the heating circuit bypasses the first heat exchanger and includes the compressor, the second heat exchanger, and the accumulator fluidly connected in series.

13. The temperature control system of claim 1, wherein the compressor is a scroll compressor, the temperature control system further comprising a liquid injection cooling line fluidly connected between the compressor and a point downstream of the receiver such that a portion of the heat transfer fluid can flow back to the compressor to cool the compressor.

14. The temperature control system of claim 13, further comprising a valve coupled with the liquid injection cooling line to control flow of the heat transfer fluid through the liquid injection cooling line, the valve being opened during a cooling cycle to permit the flow of heat transfer fluid back to the compressor, and the valve being closed during the evacuation mode.

15. A method of operating a temperature control system having a compressor, a first heat exchanger downstream of the compressor, a receiver downstream of the first heat exchanger, a valve downstream of the receiver, a second heat exchanger downstream of the valve, and an accumulator downstream of the second heat exchanger, the method comprising:

a) operating the system in a cooling mode by compressing a heat transfer fluid with the compressor;

directing the heat transfer fluid from the compressor to the first heat exchanger with a valve arrangement in a first configuration;

cooling and condensing the heat transfer fluid from the compressor in the first heat exchanger;

exchanging heat between a temperature-controlled space and the heat transfer fluid with the second heat exchanger;

receiving a mixture of liquid and vapor heat transfer fluid from the second heat exchanger into the accumulator; and directing a vapor portion of the heat transfer fluid in the accumulator to the compressor;

b) operating the system in an evacuation mode by opening a purge valve coupled to an evacuation line, the evacuation line having a first end in fluid communication with and positioned between the valve and the receiver, and a second end in fluid communication with the accumulator, the evacuation line providing flow of the heat transfer fluid from both of the first heat exchanger and the receiver to the accumulator without passing through the second heat exchanger; and substantially preventing the flow of heat transfer fluid from the second heat exchanger into the receiver with the valve;

c) operating the system in a heating mode by moving the valve arrangement from the first configuration to a second configuration;

directing the heat transfer fluid from the compressor to the second heat exchanger without passing through the first heat exchanger; and maintaining the purge valve open.

16. The method of claim 15, further comprising:

closing the purge valve only while operating the system in the cooling mode.

17. The method of claim 15, wherein operating the system in the evacuation mode further includes fluidly connecting in series an evacuation circuit including the compressor, the first heat exchanger, the receiver, the evacuation line, and the accumulator;

allowing at least a portion of the condensed heat transfer fluid to enter the accumulator from the first heat exchanger and the receiver; and bypassing the second heat exchanger.

18. The method of claim 15, further comprising entering the evacuation mode after the temperature control system exits the cooling mode and before the temperature control system enters the heating mode.

19. The method of claim 15, wherein operating the system in the cooling mode further includes directing a portion of the heat transfer fluid from a point downstream of the receiver back to the compressor through a liquid injection cooling line to cool the compressor.

20. The method of claim 15, wherein substantially preventing the flow of heat transfer fluid from the second heat exchanger into the receiver with the valve includes using an expansion valve without a bleed port.

21. The method of claim 15, wherein substantially preventing the flow of heat transfer fluid from the second heat exchanger into the receiver with the valve includes using a check valve.

* * * * *